US006751985B2

(12) United States Patent
Kimble et al.

(10) Patent No.: US 6,751,985 B2
(45) Date of Patent: Jun. 22, 2004

(54) PROCESS FOR PRODUCING A PRESSURIZED LIQUEFIED GAS PRODUCT BY COOLING AND EXPANSION OF A GAS STREAM IN THE SUPERCRITICAL STATE

(75) Inventors: E. Lawrence Kimble, Sugar Land, TX (US); Ronald R. Bowen, Magnolia, TX (US); Moses Minta, Sugar Land, TX (US); H. Gary Winningham, Anderson, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 114 days.

(21) Appl. No.: 10/391,724

(22) Filed: Mar. 19, 2003

(65) Prior Publication Data

US 2003/0177785 A1 Sep. 25, 2003

Related U.S. Application Data

(60) Provisional application No. 60/365,888, filed on Mar. 20, 2002.

(51) Int. Cl.[7] ..... F25J 1/00
(52) U.S. Cl. ..... 62/613
(58) Field of Search ..... 62/611, 613, 614

(56) References Cited

U.S. PATENT DOCUMENTS

| | | | | |
|---|---|---|---|---|
| 3,232,725 | A | 2/1966 | Secord et al. | 48/190 |
| 3,298,805 | A | 1/1967 | Secord et al. | 48/190 |
| 3,383,873 | A | 5/1968 | Becker | 62/11 |
| 4,778,497 | A | 10/1988 | Hanson et al. | 62/11 |
| 5,826,444 | A | 10/1998 | Capron et al. | 62/612 |
| 5,931,021 | A | 8/1999 | Shnaid et al. | 62/613 |
| 5,950,453 | A | 9/1999 | Bowen et al. | 62/612 |
| 5,956,971 | A | 9/1999 | Cole et al. | 62/623 |
| 6,006,545 | A | 12/1999 | Trainer | 62/615 |
| 6,016,665 | A | 1/2000 | Cole et al. | 62/612 |
| 6,023,942 | A | 2/2000 | Thomas et al. | 62/613 |
| 6,220,053 | B1 | 4/2001 | Hass, Jr. et al. | 62/613 |
| 6,253,574 | B1 | 7/2001 | Stockmann et al. | 62/612 |
| 6,367,286 | B1 | 4/2002 | Price | 62/613 |

*Primary Examiner*—Henry Bennett
*Assistant Examiner*—Malik N. Drake
(74) *Attorney, Agent, or Firm*—Gary P. Katz

(57) ABSTRACT

This invention is a method and apparatus for production of pressurized liquefied gas. First, a gas stream is cooled and expanded to liquefy the gas stream. The liquefied gas stream is then withdrawn as pressurized gas product and a portion is recycled through the heat exchanger to provide at least part of the cooling and is returned to the stream. Recycling the pressurized liquefied gas product helps keep the cooling and compression of the gas stream in the supercritcal region of the phase diagram. J-T valves in parallel with the expander permits running the system until the stream is in the supercritical region of its phase diagram and the hydraulic expander can operate. This process is suitable for natural gas streams containing methane to form a pressurized liquefied natural gas (PLNG) product.

40 Claims, 4 Drawing Sheets

PROCESS FOR PRODUCING A PRESSURIZED LIQUEFIED GAS PRODUCT BY COOLING AND EXPANSION OF A GAS STREAM IN THE SUPERCRITICAL STATE

RELATED U.S. APPLICATION DATA

This application claims the benefit of U.S. Provisional Application No. 60/365,888, filed Mar. 20, 2002.

FIELD OF THE INVENTION

The invention relates to a process for liquefaction of gas streams including natural gas and other methane-rich gas streams. More particularly, this invention relates to a process for producing a pressurized liquid gas product wherein at least a portion of the refrigeration is provided by the fluid being liquefied.

BACKGROUND OF THE INVENTION

Natural gas, because of its clean burning qualities and convenience, has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

In the design of a LNG plant, one of the most important considerations is the process for converting the natural gas feed stream into LNG. The most common liquefaction processes use some form of refrigeration system.

LNG refrigeration systems are expensive because so much refrigeration is needed to liquefy natural gas. A typical natural gas stream enters a LNG plant at pressures from about 4,830 kPa (700 psia) to about 7,600 kPa (1,100 psia) and temperatures from about 20° C. (68° F.) to about 40° C. (104° F.). Natural gas, which is predominantly methane, cannot be liquefied by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of gases, the critical temperature varies. The critical temperature of natural gas is between about −85° C. (−121° F.) and −62° C. (−80° F.). Typically, natural gas compositions at atmospheric pressure will liquefy in the temperature range between about −165° C. (−265° F.) and −155° C. (−247° F.). Since refrigeration equipment represents such a significant part of the LNG facility cost, considerable effort has been made to reduce the refrigeration costs and to reduce the weight of the liquefaction equipment for offshore applications. There is an incentive to keep the weight of liquefaction equipment as low as possible to reduce the structural support requirements for liquefaction plants on offshore structures.

Although many refrigeration cycles have been used to liquefy natural gas, the three types most commonly used in LNG plants today are: (1) "cascade cycle" which uses multiple single component refrigerants in heat exchangers arranged progressively to reduce the temperature of the gas to a liquefaction temperature, (2) "multi-component refrigeration cycle" which uses a multi-component refrigerant in specially designed exchangers, and (3) "expander cycle" which expands gas from a high pressure to a low pressure with a corresponding reduction in temperature. Most natural gas liquefaction cycles use variations or combinations of these three basic types.

The cascade system generally uses two or more refrigeration loops in which the expanded refrigerant from one stage is used to condense the compressed refrigerant in the next stage. Each successive stage uses a lighter, more volatile refrigerant which, when expanded, provides a lower level of refrigeration and is therefore able to cool to a lower temperature. To diminish the power required by the compressors, each refrigeration cycle is typically divided into several pressure stages (three or four stages is common). The pressure stages have the effect of dividing the work of refrigeration into several temperature steps. Propane, ethane, ethylene, and methane are commonly used refrigerants. Since propane can be condensed at a relatively low pressure by air coolers or water coolers, propane is normally the first-stage refrigerant. Ethane or ethylene can be used as the second-stage refrigerant. Condensing the ethane exiting the ethane compressor requires a low-temperature coolant. Propane provides this low-temperature coolant function. Similarly, if methane is used as a final-stage coolant, ethane is used to condense methane exiting the methane compressor. The propane refrigeration system is therefore used to cool the feed gas and to condense the ethane refrigerant and ethane is used to further cool the feed gas and to condense the methane refrigerant.

A mixed refrigerant system involves the circulation of a multi-component refrigeration stream, usually after precooling to about −35° C. (−31° F.) with propane. A typical multi-component system will comprise methane, ethane, propane, and optionally other light components. Without propane precooling, heavier components such as butanes and pentanes may be included in the multi-component refrigerant. The nature of the mixed refrigerant cycle is such that the heat exchangers in the process must routinely handle the flow of a two-phase refrigerant. This requires the use of large specialized heat exchangers. Mixed refrigerants exhibit the desirable property of condensing over a range of temperatures, which allows the design of heat exchanger systems that can be thermodynamically more efficient than pure component refrigerant systems.

The expander system operates on the principle that gas can be compressed to a selected pressure, cooled, typically by external refrigeration, then allowed to expand through an expansion turbine, thereby performing work and reducing the temperature of the gas. It is possible to liquefy a portion of the gas in such an expansion. The low temperature gas and liquid is then heat exchanged to effect liquefaction of the feed. The power obtained from the expansion is usually used to supply part of the main compression power used in the refrigeration cycle. The typical expander cycle for making LNG operates at pressures under about 6,895 kPa (1,000 psia). The cooling has been made more efficient by causing the components of the warming stream to undergo a plurality of work expansion steps.

Hydraulic expanders can take a gas stream in a predominately liquid or dense phase supercritical state and expand the fluid to a lower temperature and pressure. The use of hydraulic expanders to reduce the pressure and temperature of a liquid is well known in art.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. (−170° F.) will be between about 1,380 kPa (200 psia) and about 4,480 kPa (650 psia). This pressurized liquefied natural gas is referred to as PLNG to distinguish it from LNG, which is transported at or near atmospheric pressure and at a temperature of about −162° C. (−260° F.). Processes for making PLNG are disclosed in U.S. Pat. No. 5,950,453 by R. R. Bowen et al., U.S. Pat. No. 5,956,971 by E. T. Cole et al., U.S. Pat. No. 6,023,942 by E. R. Thomas et al., and U.S. Pat. No. 6,016,665 by E. T. Cole et al.

U.S. Pat. No. 6,023,942 by E. R. Thomas et al. discloses a process for making PLNG by expanding a feed gas stream rich in methane. The feed gas stream is provided with an initial pressure above about 3,100 kPa (450 psia). The gas is liquefied by a suitable expansion means to produce a liquid product having a temperature above about −112° C. (−170° F.) and a pressure sufficient for the liquid product to be at or below its bubble point temperature. Prior to the expansion, the gas can be cooled by recycle vapor that passes through the expansion means without being liquefied. A phase separator separates the PLNG product from gases not liquefied by the expansion means.

U.S. Pat. No. 6,378,330 discloses a process for liquefying a pressurized gas stream rich in methane. In that process, a first fraction of a pressurized feed stream, preferably at a pressure above 11,032 kPa (1,600 psia), is withdrawn and isentropically expanded to a lower pressure to cool and at least partially liquefy the withdrawn first fraction. A second fraction of the feed stream is cooled by indirect heat exchange with the expanded first fraction. The second fraction is subsequently expanded to a lower pressure, thereby at least partially liquefying the second fraction of the pressurized gas stream. The liquefied second fraction is withdrawn from the process as a pressurized product stream having a temperature above −112° C. (−170° F.) and a pressure at or above its bubble point pressure. Although the process of U.S. Pat. No. 6,378,330 can effectively produce PLNG, there is a need in the industry for a more efficient process for producing PLNG. The present invention satisfies this need.

SUMMARY

This invention discloses a process for producing a liquid gas product by compressing, cooling and expansion of the gas stream in the supercritical region of the phase diagram, comprising first (a) compressing the gas stream into the supercritical region of its phase diagram, (b) cooling the supercritical gas stream to a temperature less than the gas stream's critical temperature to form a supercritical dense phase fluid, (c) expanding the supercritical dense phase fluid stream without traversing the gas stream's critical point during expansion, (d) removing the expanded gas stream from the process as a liquid product, and (e) recycling a portion of the liquefied product to provide a portion of the cooling of step (b).

Another embodiment for producing a liquid gas product comprises (a) providing a gas stream having a pressure of at least 9,315 kPa (1350 psia), (b) cooling the gas stream to create a supercritical dense phase fluid stream, (c) withdrawing a portion of the supercritical dense phase fluid stream and expanding the withdrawn supercritical dense phase fluid stream and using the expanded stream to provide a portion of the cooling for step (b), (d) expanding the cooled supercritical dense phase fluid stream to a lower pressure and a temperature below the critical temperature of the gas stream to produce a liquefied product, and (e) recycling a portion of the liquefied product to provide a portion of the cooling.

The invention further comprises an apparatus for liquefying a gas stream, comprising (a) means for compressing the gas stream to the supercritical region of its phase diagram, (b) means for cooling the fluid without traversing the gas stream's critical point during expansion, (c) means for expanding the fluid without traversing the gas stream's critical point during expansion, (d) means for removing the expanded gas stream as a liquid product, and (e) means for recycling a portion of the liquefied product to provide a portion of the cooling. The process and apparatus is effective for liquefying natural gas containing methane to form a pressurized liquefied natural gas (PLNG) product.

BRIEF DESCRIPTION OF THE DRAWINGS

The present invention and its advantages will be better understood by referring to the following detailed description and the following drawings.

Figure 1:
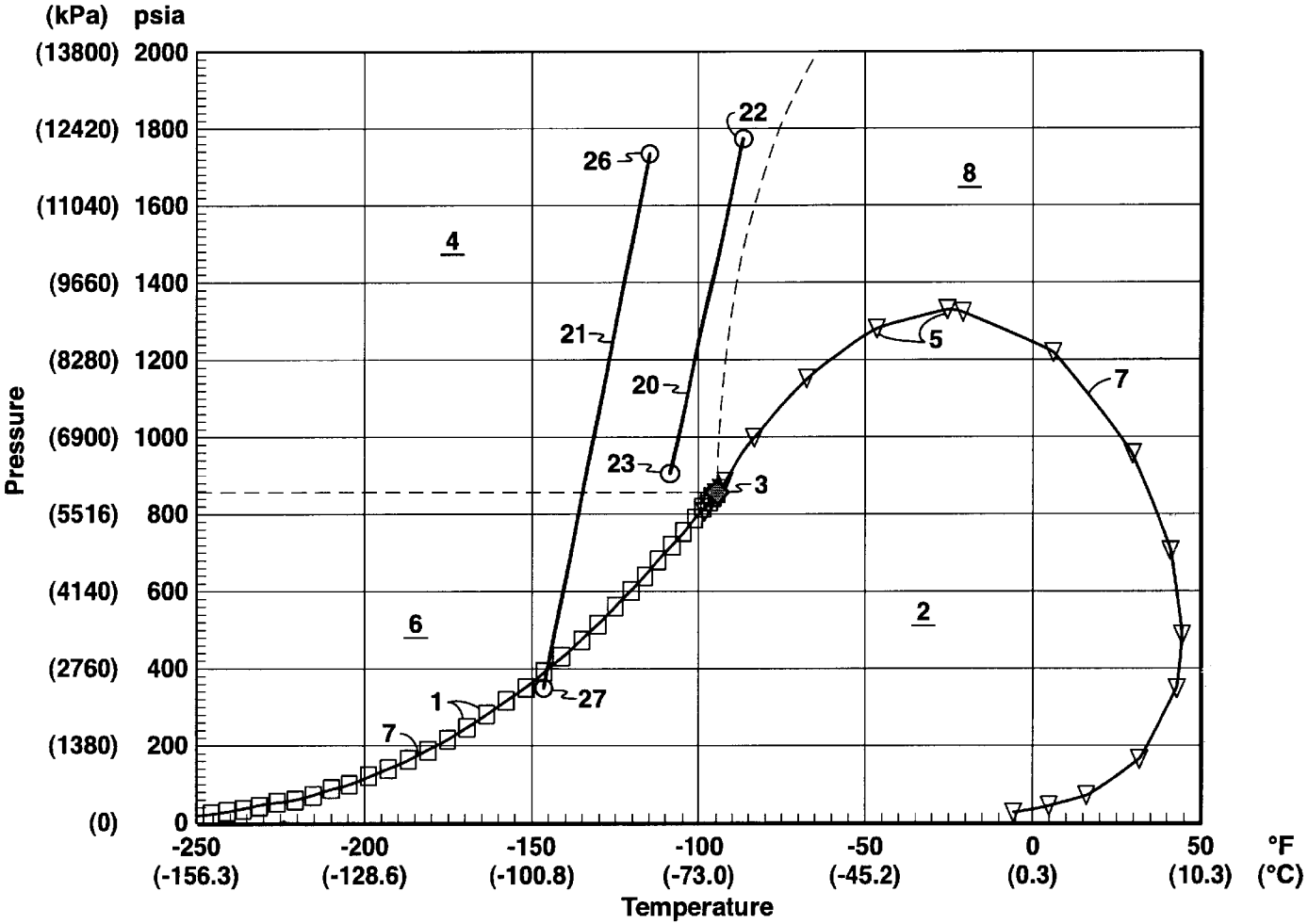
FIG. 1 is a phase diagram for methane.

The drawings illustrate specific embodiments for practicing the process of this invention. The drawings are not intended to exclude from the scope of the invention other embodiments that are the result of normal and expected modifications of the specific embodiments.

DETAILED DESCRIPTION OF THE INVENTION

The present invention is an improved process for liquefying a gas stream (i.e., natural gas) by pressure expansion to produce a liquid product (typically methane-rich) having a temperature above about −112° C. (−170° F.) and a pressure sufficient for the liquid product to be at or below its bubble point. This methane-rich product is sometimes referred to in this description as pressurized liquefied natural gas ("PLNG").

In one embodiment of this invention, one or more fractions of high-pressure, methane-rich gas is recycled to provide cooling and increase efficiency. In the liquefaction process of the present invention, the feed gas stream is pressurized to a relatively high pressure, above 9,315 kPa (1350 psia), and preferably at or above 10,342 kPa (1,500 psia). The inventors have discovered that increased thermodynamic efficiency is obtained by recycling a portion of the pressurized liquefied natural gas product (i.e., PLNG) and keeping the pressurized feed stream to the left side of the envelope of the fluid's phase diagram. Preferably, the stream remains at conditions that are a safe distance from the critical point in the fluid's phase diagram. Persons skilled in the art can determine safe distances from the critical point based on the equipment used in the liquefaction process.

The higher efficiencies of the process proposed herein are based on compressing the gas stream into the supercritical region of the phase diagram and then cooling the fluid to a temperature approximately less than the mixture's critical temperature. The resulting fluid is in a dense fluid state and can be expanded using at least one hydraulic expander or at least one J-T valve with minimum entropy losses and without traversing the critical point during the expansion. The process improvements include less overall energy consumption, a more operationally stable expansion operation, and the flexibility to operate without hydraulic expanders, when necessary, with less reduction in efficiency than would be encountered with other known processes.

The process first compresses the feed gas stream into the supercritical region and then cools the compressed gas to a temperature lower than the critical temperature of the gas mixture. A portion of the cooled dense phase, supercritical fluid may be expanded to a lower pressure and is recycled back through the liquefaction heat exchangers to provide a portion of the refrigeration needed to cool the gas stream. The remaining portion of the pressurized cooled stream is further cooled and expanded to a lower pressure to generate a pressurized liquefied gas product stream and typically an associated vapor stream. The cold vapors and a portion of the liquid product can be recycled back into the heat exchangers to provide a portion of the refrigeration needed to liquefy the feed gas stream.

FIG. 1 is a phase diagram illustrating the phase envelope defined by line 7 containing bubble point curve 1, critical point 3 and dew point curve 5 of methane. The dense supercritical fluid phase region is the region above the critical point and near or to the left of the critical temperature 4. There are four regions to the diagram. A two-phase (liquid and gas) region 2 or area inside the phase envelope, a dense supercritical fluid phase region 4, a liquefied gas phase 6, and a vapor region 8 are marked on the phase diagram.

The term "dense phase supercritical fluid phase region" is typically defined to mean that the gas has a compressibility factor less than about 0.8 but not yet in the liquid region 6. The minimum pressure necessary for a feed stream to achieve the dense phase supercritical state 4 or liquid state 6 increases with increasing temperature and is composition dependent.

The term dew point as used in this description means the temperature for a given pressure at which a gas is saturated with a condensable component (i.e., liquefied gas). For example, if a certain volume of pressurized gas is maintained at constant pressure, but its temperature is decreased, the temperature at which a liquid condensate (i.e., pressurized liquefied gas) begins to form in the gas is the dew point.

The term "bubble point" as used in this description means the temperature for a given pressure at which a liquid begins to convert to gas. For example, if a certain volume of a pressurized liquefied product is maintained at constant pressure, but its temperature is increased, the temperature at which bubbles of gas begin to form in the pressurized liquefied product is the bubble point. Similarly, if a certain volume of a pressurized liquefied product is held at constant temperature but the pressure is reduced, the pressure at which gas begins to form defines the bubble point pressure at that temperature. At the bubble point, the liquefied gas is saturated liquid.

For most natural gas compositions, the bubble point pressure of the natural gas at temperatures above −112° C. will be above about 1,380 kPa (200 psia). The term natural gas as used in this description means a gaseous feed stock suitable for manufacturing of a pressurized liquefied product. The natural gas could comprise gas obtained from a crude oil well (associated gas) or from a gas well (non-associated gas). The composition of natural gas can vary significantly.

As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, dirt, iron sulfide, wax, and crude oil. The solubilities of these contaminants vary with temperature, pressure, and composition. If the natural gas stream contains heavy hydrocarbons that could freeze out during liquefaction or if the heavy hydrocarbons are not desired in a pressurized liquefied product because of compositional specifications or their value as condensate, the heavy hydrocarbons are typically removed by a separation process such as fractionation prior to liquefaction of the natural gas.

At the operating pressures and temperatures of a pressurized liquefied product, moderate amounts of nitrogen in the natural gas can be tolerated since the nitrogen can remain in the liquid phase of a pressurized liquefied product. Since the bubble point temperature of a pressurized liquefied product at a given pressure decreases with increasing nitrogen content, it will normally be desirable to manufacture a pressurized liquefied product with a relatively low nitrogen concentration. While the present invention is primarily for the production of PLNG, the process can be used to produce other liquid products.

Figure 2:
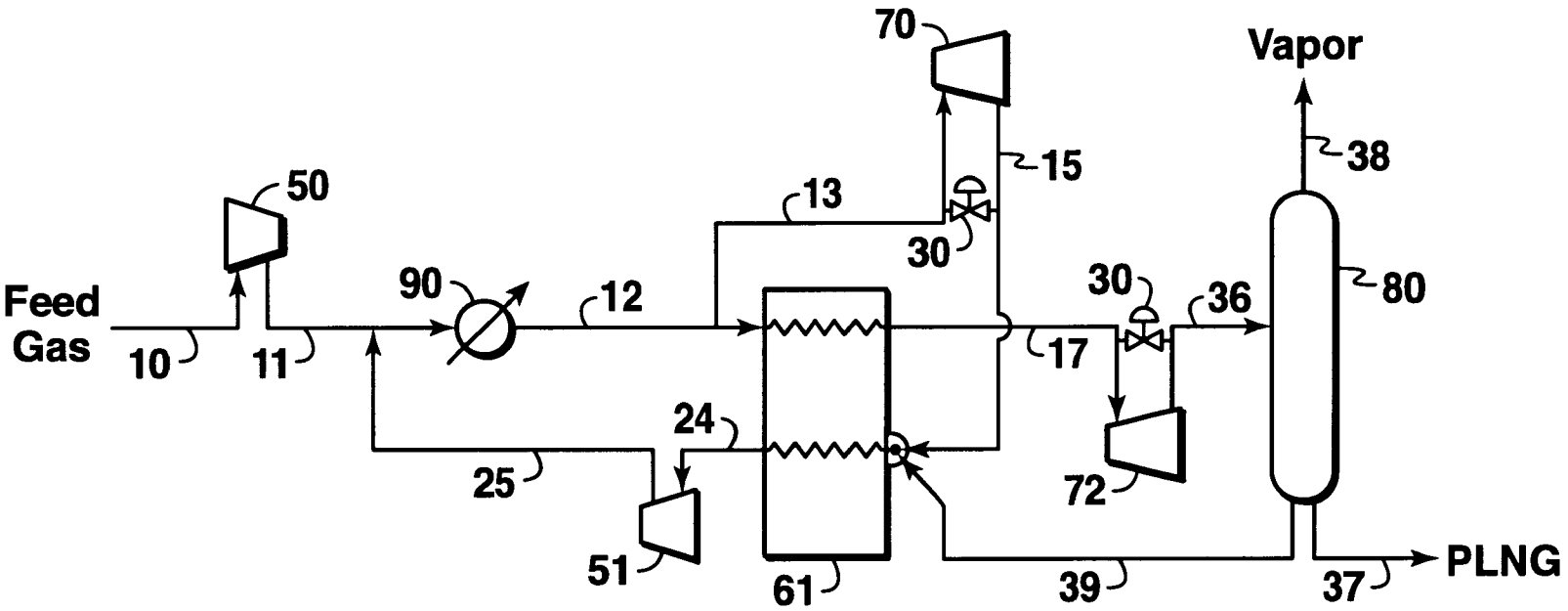
FIG. 2 is a schematic flow diagram of a first embodiment for producing a pressurized liquefied gas product in accordance with the process of this invention.

FIG. 2 is a schematic flow diagram of one embodiment for production of a pressurized liquefied gas product using the present invention. Referring to FIG. 2, pressurized feed gas stream 10 enters the liquefaction process and typically requires further pressurization by one or more stages of compression to obtain a preferred pressure above 10,340 kPa (1,500 psia), and more preferably above 13,800 kPa (2,000 psia). However, it should be understood, that this compression stage would be optional if the gas feed stream is available at a pressure above 9,315 kPa (1350 psia). After each compression stage, the compressed vapor may optionally be cooled, preferably by one or more conventional air or water coolers. For ease of illustrating the process of the present invention, FIG. 2 shows only one stage of compression (compressor 50) followed by one cooler (cooler 90).

The feed gas 10 is compressed in compressor 50 and exits as stream 11. Stream 11 is then cooled in cooler 90 and exits as stream 12.

A portion of stream 12 is passed through heat exchanger 61 and exits as stream 17. A portion of the compressed vapor stream 12 is withdrawn as stream 13 and passed through an expansion means 70 to reduce the pressure and temperature of gas stream 13, thereby producing a cooled stream 15 that is at least partially liquefied gas. Stream 15 is passed through heat exchanger 61 and exits the heat exchanger as stream 24. In passing through the heat exchanger 61, stream 15 cools by indirect heat exchange the portion of pressurized stream 12 that passes through heat exchanger 61 so that the stream 17 exiting heat exchanger 61 is substantially cooler than stream 12.

Stream 24 is compressed by one or more compression stages with optional cooling after each stage. In FIG. 2, after the gas is compressed by compressor 51, the compressed stream 25 is recycled by being combined with the pressurized feed stream, preferably by being combined with stream 11 upstream of cooler 90.

Stream 17 is passed through an expansion means 72 for reducing pressure of stream 17. The fluid stream 36 exiting the expansion means 72 is preferably passed to one or more phase separators 80 which separate the liquefied natural gas from any gas (i.e., vapor) 38 that was not liquefied by expansion means 72. The operation of such phase separators is well known to those of ordinary skill in the art. The liquefied gas is then passed as product stream 37 having a temperature above −112° C. (−170° F.) and a pressure at or above its bubble point pressure to a suitable storage or transportation means (not shown) and the gas phase from a phase separator (stream 38) may be used as fuel or recycled to the process for liquefaction.

A portion 39 of the product stream may be recycled back by being withdrawn from the product stream 37 or phase separator 80. This withdrawn stream 39 is passed through heat exchanger 61 to provide at least a portion of the cooling. The withdrawn liquefied product stream 39 may be combined with stream 15 or passed independently through the heat exchanger and later combined with stream 24.

The process can be started quickly by using Joule-Thompson (J-T) valves 30 installed in parallel with hydraulic expanders 70 and 72. Since the compressed fluid stream is cooled to a temperature below its critical temperature, the process operates more efficiently on J-T valves than a dense phase process working above the critical temperature. The liquid expanders are brought online after process stability is attained and the design conditions of the hydraulic expanders have been obtained. J-T valves 30 may be used to bypass the liquid or hydraulic expanders until the process operating parameters are sufficiently stabilized to bring the hydraulic expander online. An apparatus having the J-T valves 30 in parallel with the expanders permits continued liquefied gas production if an expander fails by bypassing the expander with a J-T valve 30 with only a moderate loss in efficiency, but no production downtime.

Figure 3:
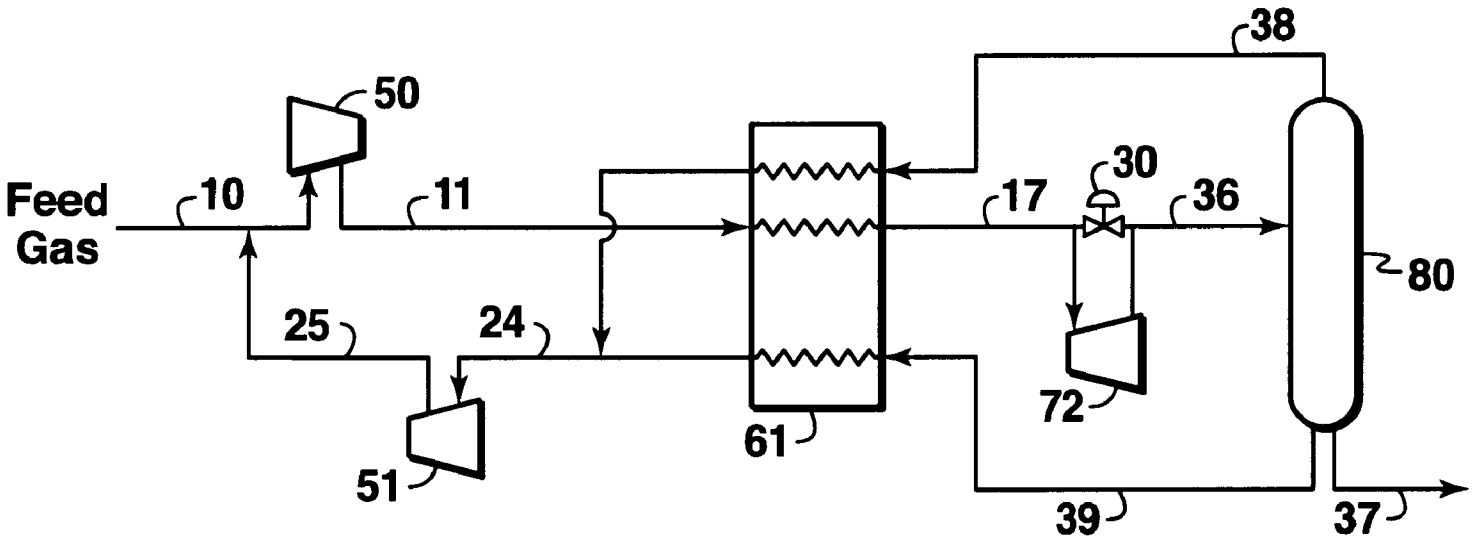
FIG. 3 is a schematic flow diagram of a second embodiment for producing a pressurized liquefied gas product, in accordance with the process of this invention, which is similar to the process shown in FIG. 1 except that external refrigeration is no longer necessary to pre-cool the incoming gas stream.

FIG. 3 is a diagrammatic illustration of a simplified embodiment of the invention that is similar to the embodiment of FIG. 2 in which the like elements to FIG. 2 have been given like numerals. The principal differences between the process of FIG. 3 and the process of FIG. 2 are that in the FIG. 3 process (1) expander 70 and streams 13 and 15 of FIG. 2 have been eliminated and (2) the vapor 38 is passed through the heat exchanger 61 to provide at least a portion of the cooling and is combined with stream 24 to be compressed by one or more compression devices 51 to approximately the pressure of feed stream 11 exiting as stream 25 and then combined with feed stream 11. This simplified process can be accomplished through the use of the vapor stream 38 to provide the initial cooling of heat exchanger 61 until the streams are liquefied. Once the streams are liquefied, the liquefied gas product is recycled and therefore, available to provide a portion of the cooling of heat exchanger 61.

Figure 4:
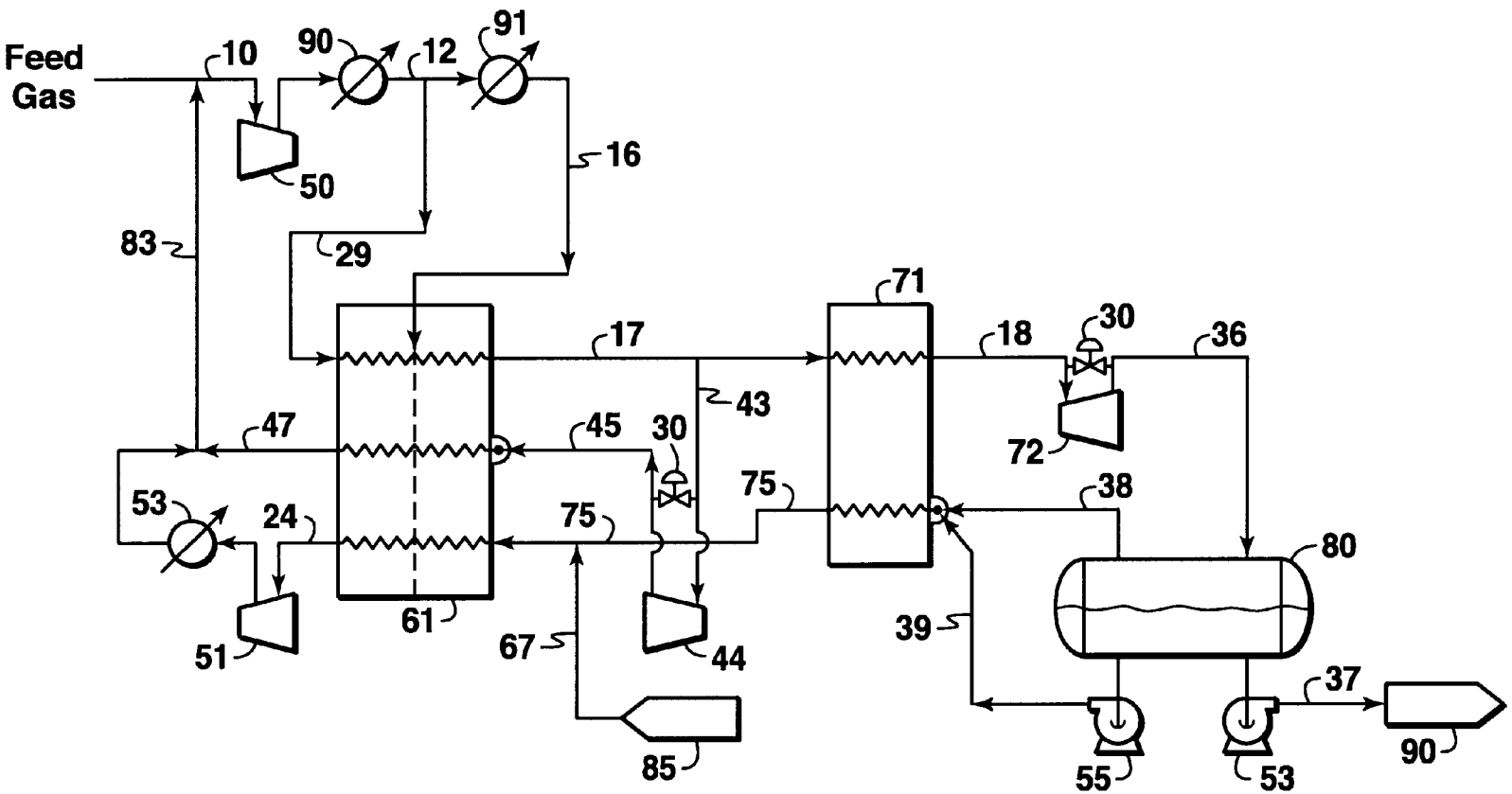
FIG. 4 is a schematic flow diagram of a third embodiment for producing a pressurized liquefied gas product in accordance with the process of this invention which uses more than one expansion stage and more than one heat exchanger for cooling the gas to pressurized liquefied gas conditions.

FIG. 4 illustrates a schematic diagram of another embodiment of the present invention in which the like elements to FIG. 3 have been given like numerals. First, the feed stream 10 is compressed by compression means 50 and cooled by a conventional water cooler 90. The use of a conventional water cooler to cool a feed stream is well known in the art. A portion of stream 12 may be optionally withdrawn as stream 16 to be cooled and provide at least a reduction in the cooling load of heat exchanger 61 and is combined with stream 29 inside heat exchanger 61 and exits as stream 17. The remaining portion of stream 12 after stream 16 is withdrawn becomes stream 29.

Stream 16 is cooled by passing through a conventional, closed-loop refrigeration system 91. A single, multi-component, or cascade refrigeration system may also be used. A cascade refrigeration system could comprise at least two closed-loop refrigeration cycles. The closed-loop refrigeration cycles may use, for example and not as a limitation on the present invention, refrigerants such as, methane, ethane, propane, butane, pentane, carbon dioxide, and nitrogen. Preferably, the closed-loop refrigeration system 91 uses propane as the predominant refrigerant.

A portion of cooled stream 17 is withdrawn as stream 43 and is passed through an expansion means 44 to reduce the pressure and temperature of gas stream 43, thereby producing a cooled stream 45 that is a dense phase or partially liquefied gas. Stream 45 is passed through heat exchanger 61 and exits the heat exchanger as stream 47. In passing through the heat exchanger 61, stream 45 cools by indirect heat exchange the pressurized gas stream 29 as it passes through heat exchanger 61 so that the stream 17 exiting heat exchanger 61 is substantially cooler than stream 29. The remaining portion of stream 17 that is not withdrawn as stream 43 is passed through heat exchanger 71 and exits heat exchanger as stream 18.

Stream 18 is passed through an expansion means 72, exiting as stream 36 and thereby reducing the pressure of the stream. The fluid stream 36 exiting the expansion means 72 is preferably passed to one or more phase separators 80 which separate the liquefied natural gas from any gas (i.e., vapor) 38 that was not liquefied by expansion means 72.

The vapor stream 38 may optionally be introduced to the liquefaction process to recycle vapor produced from the pressurized liquefied gas. One or more pumps 53 may be used to send the pressurized liquefied gas 37 to storage, ship 90 or pipeline. A portion of the pressurized liquefied gas is withdrawn as stream 39 and one or more pumps 55 are used to combine stream 39 with vapor stream 38. The pressurized liquefied gas 39 and vapor stream 38 are then passed through heat exchanger 71 exiting as stream 75 so that the stream 18 exiting heat exchanger 71 is substantially cooler than stream 17. Stream 75 is then passed through heat exchanger 61 to provide a portion of the cooling and exits as stream 24. Stream 24 is compressed by compressor 51 and cooled by water cooler 53 and then combined with stream 47 to form stream 83. Stream 83 is then combined with stream 10. The vapor stream 67 from loading ship 85 may be combined with stream 75 after it exits heat exchanger 71 and before it enters heat exchanger 61.

One skilled in the art could add additional refrigeration cycles, heat exchangers and expanders to the embodiments discussed above. U.S. Pat. Nos. 6,378,330, 5,950,453, 5,956,971, 6,016,665, 6,023,942 and other patents and art disclose configurations of systems to produce liquefied natural gas (LNG) and pressurized liquefied natural gas (PLNG). These systems can be combined with the present invention.

This invention recycles pressurized liquefied natural gas to provide at least part of the cooling to keep the stream in a region of the phase diagram that is at least partially liquid (i.e., in the dense phase supercritical region 4, two-phase (liquid and gas) region 2, and a liquefied gas phase region 6) or generally to the left of its critical point. Persons skilled in the art could, based on the disclosure of this invention, modify many existing liquefied natural gas production apparatuses to practice this invention.

In the storage, transportation, and handling of liquefied natural gas, there can be a considerable amount of what is commonly referred to as "boil-off," the vapors (i.e., 38 in FIG. 4) resulting from evaporation of liquefied natural gas. The process of this invention can optionally re-liquefy boil-off vapor. Depending on the pressure of the boil-off vapor, the boil-off vapor may need to be pressure adjusted by one or more compressors or expanders (not shown in the Figures) to match the pressure at the point the boil-off vapor enters the liquefaction process.

In designing a liquefaction plant that implements the process of this invention, the number of discrete expansion stages will depend on technical and economic considerations, taking into account the inlet feed pressure, the product pressure, equipment costs, available cooling medium and its temperature. Increasing the number of stages improves thermodynamic performance but increases equipment cost. Persons skilled in the art could perform such optimizations in light of the teachings of this description.

This invention is not limited to any type of heat exchanger, but because of economics, plate-fin type heat exchangers in a cold box are preferred, which all cool by indirect heat exchange. The term "indirect heat exchange" as used in this description and claims, means the bringing of two fluid streams into heat exchange relation without any physical contact or intermixing of the fluids with each other. Preferably all streams containing both liquid and vapor phases that are sent to heat exchangers have both the liquid and vapor phases equally distributed across the cross section area of the passages they enter. To accomplish this, distribution apparati can be provided by those skilled in the art for individual vapor and liquid streams. Separators (not shown in the drawings) can be added to the multi-phase flow streams as required to divide the streams into liquid and vapor streams.

In FIGS. 2–4, the expansion means 70, 72, and 44 can be any pressure reduction device or devices suitable for controlling flow and/or reducing pressure in the line and can be, for instance, in the form of a turboexpander, a Joule-Thomson (J-T) valve, or a combination of both, such as, for example, a Joule-Thomson valve and a turboexpander in parallel or in series, which provides the capability of using either or both the Joule-Thomson valve and the turboexpander simultaneously. The expanders used in the present invention may be shaft-coupled to suitable compressors, pumps, or generators, enabling the work extracted from the expanders to be converted into usable mechanical and/or electrical energy, thereby resulting in a considerable energy saving to the overall system. However, the preferred expander is a hydraulic expander which requires the stream to be in the liquefied gas state or at least in dense phase supercritical vapor state.

EXAMPLE

A hypothetical mass and energy balance was carried out to illustrate the embodiment shown in FIG. 4, and the results are shown in the Table below. The data were obtained using a commercially available process simulation program called HYSYS™ (available from Hyprotech Ltd. of Calgary, Canada). However, other commercially available process simulation programs can be used to develop the data, including for example HYSIM™, PROII™, and ASPEN PLUS™, which are familiar to persons of ordinary skill in the art. The data presented in the Table are offered to provide a better understanding of the embodiment shown in FIG. 4, but the invention is not to be construed as unnecessarily limited thereto. The temperatures, pressures, compositions, and flow rates can have many variations in view of the teachings herein. This example assumed the natural gas feed stream 10 had the following composition in mole percent: $C_1$ (methane): 94.3%; $C_2$ (ethane): 3.1%; $C_3$ (propane): 1.3%; $C_4$ (butanes): 0.7%; $C_5$ (pentanes): 0.2%.

The temperature and pressure change of the liquefied gas streams at the inlet and outlets of hydraulic expanders of the hypothetical test run using HYSYS™, are shown as lines 20 and 21 in the phase diagram (FIG. 1). As shown in the table, stream 43 enters the inlet of hydraulic expander 44 with a pressure and temperature of 12,100 kPa and −67.8° C. (point 22 in FIG. 1) and exits the outlet of hydraulic expander 44 as stream 45 with a pressure and temperature of 6,205 kPa and −77.3° C. (point 23 in FIG. 1). Line 20 of FIG. 1 illustrates that the cooling of stream 43 in hydraulic expander 44 is entirely in the supercritical region 4 of the phase diagram. Stream 18 entering hydraulic expander 72 has a pressure and temperature of 12,031 kPa and −80.6° C. (point 26 in FIG. 1) and exits outlet of hydraulic expander as stream 36 with a pressure and temperature of 2,654 kPa and −98.2° C. (point 27 in FIG. 1). Line 21 of FIG. 1 illustrates that the cooling of hydraulic expander 71 cools stream 18 from the supercritical fluid phase region 4 through the liquefied gas phase 6 and past the bubble point 1 into the two-phase (liquid and gas) region 2.

A person skilled in the art, particularly one having the benefit of the teachings of this patent, will recognize many modifications and variations to the specific embodiments disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. Additionally, certain process steps may be accomplished by adding devices that are interchangeable with the devices shown. As discussed above, the specifically disclosed embodiment and example should not be used to limit or restrict the scope of the invention, which is to be determined by the claims below and their equivalents.

TABLE

| Stream # | Temperature Deg C. | Pressure kPa | Flowrate Kgmol/hr |
|---|---|---|---|
| 10 | 15.9 | 5,516 | 101,760 |
| 12 | 18.3 | 12,445 | 101,760 |
| 16 | −37.1 | 12,169 | 54,953 |
| 17 | −67.8 | 12,100 | 101,760 |
| 18 | −80.6 | 12,031 | 52,096 |
| 24 | 13.9 | 2,448 | 16,083 |
| 36 | −98.2 | 2,654 | 52,096 |
| 38 | −98.2 | 2,654 | 7,397 |
| 39 | −97.8 | 2,930 | 6,074 |
| 43 | −67.8 | 12,100 | 49,669 |
| 45 | −77.3 | 6,205 | 49,669 |
| 47 | 13.9 | 6,067 | 49,669 |
| 75 | −70.6 | 2,586 | 13,466 |
| 83 | 14.9 | 6,067 | 64,411 |
| 87 | −78.9 | 2,655 | 2,617 |

What is claimed is:

1. A process for liquefying a gas stream by compressing, cooling and expansion of the gas stream in the supercritical region of the phase diagram, comprising:

(a) compressing the gas stream into the supercritical region of its phase diagram;

(b) cooling the supercritical gas stream to a temperature less than the gas stream's critical temperature to form a supercritical dense phase fluid;

(c) expanding the supercritical dense phase fluid stream without traversing the gas stream's critical point during expansion;

(d) removing the expanded gas stream from the process as a liquid product; and (e) recycling a portion of the liquefied product to provide a portion of the cooling of step (b).

2. The process of claim 1 wherein the gas stream contains methane.

3. The process of claim 1 wherein the gas stream is cooled in at least one heat exchanger.

4. The process of claim 1 wherein the gas stream is expanded in step (c) in at least one hydraulic expander.

5. The process of claim 1 wherein the gas stream is expanded in step (c) with at least one J-T valve.

6. The process of claim 1 wherein the gas is expanded in step (c) with a combination of at least one hydraulic expander and at least one J-T valve.

7. The process of claim 1 wherein the fluid stream is expanded in step (c) in at least one J-T valve until the stream becomes a dense fluid and then the stream is expanded in at least one hydraulic expander.

8. The process of claim 1 wherein the liquefied product is pressurized liquefied natural gas.

9. Pressurized liquefied gas produced according to the process of claim 1.

10. A process for producing a liquid gas product comprising:

(a) providing a gas stream having a pressure of at least 9,315 kPa (1350 psia);

(b) cooling the gas stream to create a supercritical dense phase fluid stream;

(c) withdrawing a portion of the supercritical dense phase fluid stream and expanding the withdrawn supercritical dense phase fluid stream and using the expanded stream to provide a portion of the cooling for step b;

(d) expanding the remaining portion of the cooled supercritical dense phase fluid stream to a lower pressure and a temperature below the critical temperature of the gas stream to produce a liquefied product; and (e) recycling a portion of the liquefied product to provide a portion of the cooling for step b.

11. The process of claim 10 wherein the gas stream contains methane.

12. The process of claim 10 wherein the gas stream is cooled in at least one heat exchanger.

13. The process of claim 10 wherein the gas stream is expanded in steps (c) and (d) in at least one hydraulic expander.

14. The process of claim 10 wherein the gas stream is expanded in steps (c) and (d) with at least one J-T valve.

15. The process of claim 10 wherein the gas is expanded in steps (c) and (d) with a combination of at least one hydraulic expander and at least one J-T valve.

16. The process of claim 10 wherein the gas stream is expanded in steps (c) and (d) in at least one J-T valve until the stream becomes a dense fluid and then the stream is expanded in at least one hydraulic expander.

17. The process of claim 10 wherein the liquefied product is pressurized liquefied natural gas.

18. The process of claim 10 wherein said gas stream in the supercritical region is at a lower temperature than the critical temperature of the gas stream.

19. A process for liquefying a pressurized gas stream, which comprises:

(a) withdrawing a first fraction of the pressurized gas stream thereby leaving a second fraction and expanding the withdrawn first fraction to a lower pressure to cool and at least partially liquefy the withdrawn first fraction;

(b) cooling the second fraction of the pressurized gas stream by indirect heat exchange with the expanded first fraction;

(c) expanding the second fraction of the pressurized gas stream to a lower pressure, thereby at least partially liquefying the second fraction of the pressurized gas stream;

(d) removing a portion of the liquefied second fraction from the process as a pressurized product stream having a pressure at or above its bubble point pressure; and (e) recycling a portion of the liquefied second fraction from the pressurized product stream to provide a portion of the cooling in step (b).

20. The process of claim 19 wherein the gas stream contains methane.

21. The process of claim 19 wherein the gas stream is cooled in at least one heat exchanger.

22. The process of claim 19 wherein the gas stream is expanded in steps (a) and (c) in at least one hydraulic expander.

23. The process of claim 19 wherein the gas stream is expanded in steps (a) and (c) with at least one J-T valve.

24. The process of claim 19 wherein the gas is expanded in steps (a) and (c) with a combination of at least one hydraulic expander and at least one J-T valve.

25. The process of claim 19 wherein the gas stream is expanded in steps (a) and (c) in at least one J-T valve until the stream becomes a dense fluid stage and then the stream is expanded in at least one hydraulic expander.

26. The process of claim 19 wherein the liquefied product is pressurized liquefied natural gas.

27. A process for liquefying a pressurized gas stream to create a pressurized liquefied gas product by compressing, cooling and expansion of the gas stream in the supercritical region of the phase diagram at temperatures lower than the critical temperature of the stream, comprising:

(a) compressing a gas stream to a pressure of at least 9,315 kPa (1,350 psia) and cooling the gas stream to a temperature of at least 41° C. (105° F.);

(b) cooling the pressurized gas stream in a first heat exchanger by indirect heat exchange with the expanded first fraction from step (c) and the vapor and pressurized liquefied gas product from step (h);

(c) withdrawing a first fraction from the cooled gas stream of step (b), thereby leaving a second fraction of the pressurized gas stream, and expanding the withdrawn first fraction to a lower pressure to cool and at least partially liquefy the first fraction;

(d) cooling the second fraction of the pressurized gas stream in a second heat exchanger by indirect heat exchange with the vapor and pressurized liquefied gas product from step (h);

(f) pressure expanding the second fraction to a lower pressure, thereby at least partially liquefying the second fraction of the pressurized gas stream;

(g) passing the expanded second fraction of step (f) to a phase separator which separates vapor produced by the expansion of step (f) from liquid produced by such expansion;

(h) removing vapor and a portion of the liquefied gas product from the phase separator and passing the vapor and the pressurized liquefied gas product in succession through the second heat exchanger and then the first heat exchanger;

(i) compressing and cooling the vapor and pressurized liquefied gas exiting the first heat exchanger and returning the compressed, cooled vapor and pressurized liquefied gas to the pressurized stream for recycling; and (j) removing from the phase separator a pressurized liquefied product.

28. The process of claim 27 wherein the gas stream contains methane.

29. The process of claim 27 wherein the gas stream is expanded in steps (c) and (f) in at least one hydraulic expander.

30. The process of claim 27 wherein the gas stream is expanded in steps (c) and (f) with at least one J-T valve.

31. The process of claim 27 wherein the gas is expanded in steps (c) and (f) with a combination of at least one gas expander and at least one J-T valve.

32. The process of claim 27 wherein the gas stream is expanded in steps (c) and (f) in at least one J-T valve until the stream becomes a dense fluid stage and then the stream is expanded in at least one hydraulic expander.

33. The process of claim 27 wherein the liquefied product is pressurized liquefied natural gas.

34. A process for liquefying a pressurized gas stream to create a pressurized liquefied gas product by compressing, cooling and expansion of the gas stream in the supercritical region of the phase diagram at temperatures lower than the critical temperature of the stream, comprising:

(a) compressing a gas stream to a pressure of at least 9,315 kPa (1,350 psia) and cooling the gas stream to a temperature of at least 41° C. (105° F.);

(b) cooling the pressurized gas stream in a first heat exchanger by indirect heat exchange;

(c) withdrawing a first fraction from the cooled gas stream of step (b), thereby leaving a second fraction of the pressurized gas stream, and expanding the withdrawn first fraction to a lower pressure to cool and at least partially liquefy the first fraction in step (b);

(d) cooling the second fraction of the pressurized gas stream in a second heat exchanger by indirect heat exchange;

(e) pressure expanding the second fraction to a lower pressure, thereby at least partially liquefying the second fraction of the pressurized gas stream;

(f) passing the expanded second fraction of step (f) to a phase separator which separates vapor produced by the expansion of step (f) from liquid produced by such expansion;

(g) removing vapor and a portion of the liquefied gas product from the phase separator and passing the vapor and the pressurized liquefied gas product in succession through the second heat exchanger in step (d) and then the first heat exchanger in step (b);

(h) compressing and cooling the vapor and pressurized liquefied gas exiting the first heat exchanger and returning the compressed, cooled vapor and pressurized liquefied gas to the pressurized stream for recycling; and (i) removing from the phase separator a pressurized liquefied product.

35. An apparatus for liquefying a gas stream, comprising:

(a) means for compressing the gas stream to the supercritical dense phase region of its phase diagram;

(b) means for cooling the fluid without traversing the gas stream's critical point during cooling;

(c) means for expanding the fluid without traversing the gas stream's critical point during expansion;

(d) means for removing the expanded gas stream as a liquid product; and (e) means for recycling a portion of the liquefied product to provide a portion of the cooling for step (b).

36. The apparatus of claim 35 wherein the means for cooling is at least one heat expander.

37. The apparatus of claim 35 wherein the means for expanding is at least one gas expander.

38. The apparatus of claim 35 wherein the means for expanding is at least one J-T valve.

39. The apparatus of claim 35 wherein the means for expanding is a combination of at least one gas expander and at least one J-T valve.

40. The apparatus of claim 35 wherein the apparatus further comprises means for withdrawing a fraction of the gas stream, means for expanding the withdrawn gas stream to cool the withdrawn gas stream and means for using the withdrawn and expanded gas stream to provide a portion of the cooling in step (b).

* * * * *